US005120100A

United States Patent [19]

Doty

[11] Patent Number: 5,120,100

[45] Date of Patent: Jun. 9, 1992

[54] LIFTING AND GRIPPING APPARATUS

[75] Inventor: John T. Doty, Long Beach, Calif.

[73] Assignee: Crescent Pipe Tongs, Incorporated, Long Beach, Calif.

[21] Appl. No.: 559,695

[22] Filed: Jul. 30, 1990

[51] Int. Cl.[5] ..... B66C 1/44; B66C 1/62

[52] U.S. Cl. ..... 294/116; 294/110.1

[58] Field of Search ..... 294/116, 106, 110.1, 294/113, 81.61, 104, 114, 118, 119

[56] References Cited

U.S. PATENT DOCUMENTS

| | | | |
|---|---|---|---|
| 1,216,362 | 2/1917 | Richards et al. | 294/116 X |
| 1,457,104 | 5/1923 | Connor et al. | 294/116 |
| 2,286,071 | 6/1942 | Dragan et al. | 294/110.1 X |
| 2,397,554 | 4/1946 | Lontz | 294/116 |
| 2,520,815 | 8/1950 | Shaboo | 294/116 |
| 2,655,401 | 10/1953 | Kelso | 294/106 |
| 2,853,336 | 9/1958 | Cruikshank et al. | 294/116 X |
| 2,890,906 | 6/1959 | Jacquart | 294/110.10 X |
| 2,911,251 | 11/1959 | Osborn | 294/110.10 |
| 3,068,036 | 12/1962 | Doty | 294/116 X |
| 3,455,593 | 7/1969 | Moro | 294/119.10 X |
| 3,479,078 | 11/1969 | Doty | 294/110.1 X |
| 3,488,080 | 1/1970 | Hamilton | 294/110.10 |
| 3,527,495 | 9/1970 | Maradyn | 294/106 X |
| 3,897,099 | 7/1975 | Scodino et al. | 294/106 X |
| 3,975,045 | 8/1976 | Abarotin et al. | 294/106 X |

*Primary Examiner*—Johnny D. Cherry
*Attorney, Agent, or Firm*—Joseph R. Evanns

[57] ABSTRACT

Lifting and Gripping Apparatus for massive workpieces such as pipes comprises a stationary member and two moveable members, pivoted thereto at points higher than the springline of the workpiece and displaced from one another so as to operate in separate paths. Latching members operate in separate paths between an open position in which there is disengagement with the workpiece and a closed position in which there is engagement with the workpiece for purposes of lifting. Lifting force produces motion of the moveable members through associated cam members such that there is engagement with the workpiece.

9 Claims, 5 Drawing Sheets

LIFTING AND GRIPPING APPARATUS

BACKGROUND OF THE INVENTION

1. Field of the Invention

This invention relates to apparatus and equipment for gripping and lifting objects, and in particular to massive objects required to be lifted and released in limited areas, such as sewer piping in confined trenches.

2. Description of Prior Devices

The need for reliable and safe equipment for gripping and lifting massive objects in confined spaces, as for example oil pipe or sewer pipe in and out of trenches, is of long standing. Numerous devices have been provided to meet this need. For example, U.S. Pat. Nos. 3,068,036 and 3,011,821 to the inventor hereof, John T. Doty, disclose pipe handling tongs which comprise essentially a shoe and a pipe handling segment moveable against a pipe for frictional engagement of the pipe between the moveable segment and the shoe. These devices have proved successful in numerous industrial and technical applications.

In certain applications, however, and especially those arising in recent years, there has been a requirement for increased compactness of operation of gripping and lifting devices as well as greater lifting and gripping capacity. An important example of such an application involves construction projects. In such activities, it is necessary to install pipe (and on occasion to remove old pipe) and to dig trenches for the purpose. Due to the high cost of such construction projects, it is necessary from the economic point of view to minimize the size of the trenches in which the pipes are to be laid, thus necessitating minimization of the space required for operation of gripping and lifting equipment used in lifting and laying such pipe. Further contributing to the need for compact operation of such equipment is the problem of toxic waste and toxic soil which has arisen comparatively recently with respect to performing pipe installation, particularly in urban areas. In such situations, the older techniques of digging a larger trench than necessary for the actual accommodation of the pipe, in order to provide sufficient space for operation of the pipe lifting and laying equipment, then filling up the hole after such equipment has performed its function, is not feasible. In these circumstances, if the soil is toxic in the first place, it cannot be replaced in the trench, and fill will be required to be transported from a different site, thus multiplying cost. Further, with respect to insurance requirements and governmental regulations, in the context of toxic soil/fill, it is most practical and desirable to minimize the amount of soil/fill handling in the first place and thus to excavate as compact trenches as possible.

Also, in recent times, the size and massiveness of pipe or other material to be lifted and laid into or from trenches has increased, with the increase of residential and commercial densities.

Therefore, there has been a felt but unfulfilled need for apparatus for lifting and gripping massive workpieces such as pipes in respect to confined areas such as trenches.

SUMMARY OF THE INVENTION

Gripping and lifting apparatus is provided comprising a stationary member, first and second gripping members pivotably mounted upon said stationary member not lower than the horizontal diameter of a transverse section of the workpiece, the stationary member being configured to be fittable onto, and into frictional engagement with, the workpiece, and further including a first cam member pivotably mounted upon said first gripping member and a second cam member pivotably mounted upon said second gripping member, the first and second cam members being positioned off-set from one another to move in separate paths from one another, and being moveable between an open position, in which the apparatus is disengaged from the workpiece and a closed position in which the apparatus is in gripping engagement with the workpiece, said apparatus further including a first gripping engagement section on said first gripping member and a second gripping engagement section on said second gripping member, the first and second gripping engagement sections being configured and positioned to grip the workpiece substantially opposite one another.

Latching means for latching the apparatus in the open position is provided as is a stationary member defining recesses therein for containment of the first and second gripping members.

DETAILED DESCRIPTION OF THE PREFERRED EMBODIMENT AND BEST MODE OF OPERATION

Figure 1:
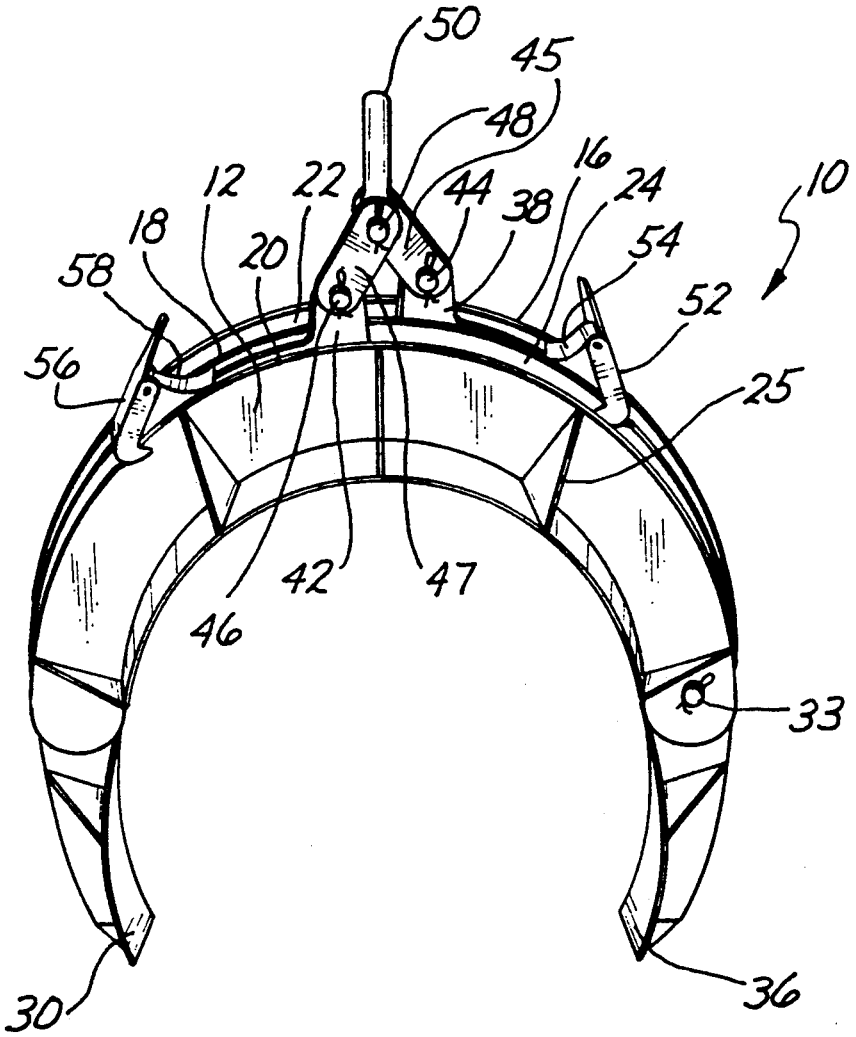
FIG. 1 is a perspective view of gripping and lifting apparatus in accordance with the invention.
Figure 2:
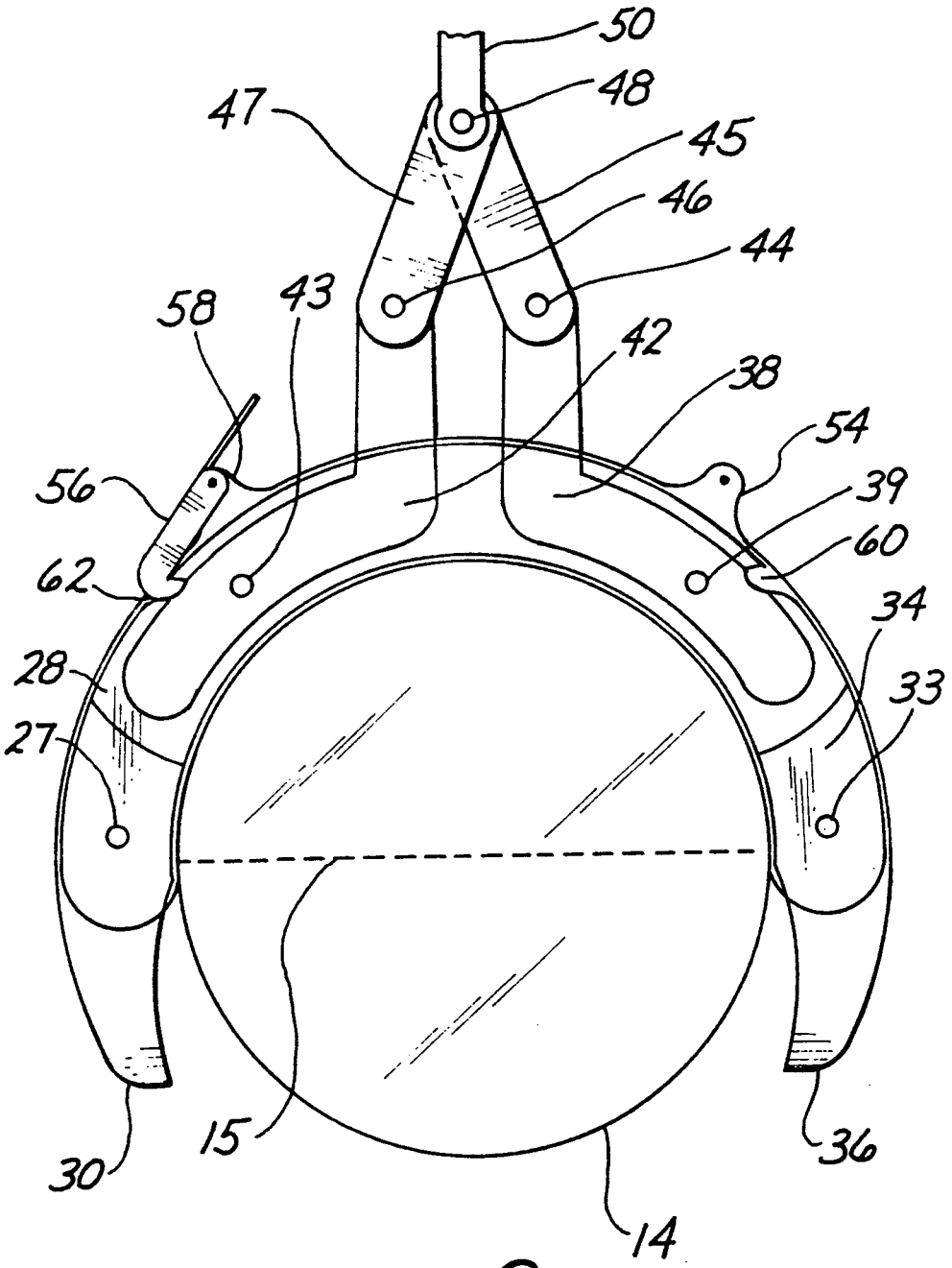
FIG. 2 is a side view, somewhat simplified and broken away, of apparatus in accordance with the invention in an open position.
Figure 3:
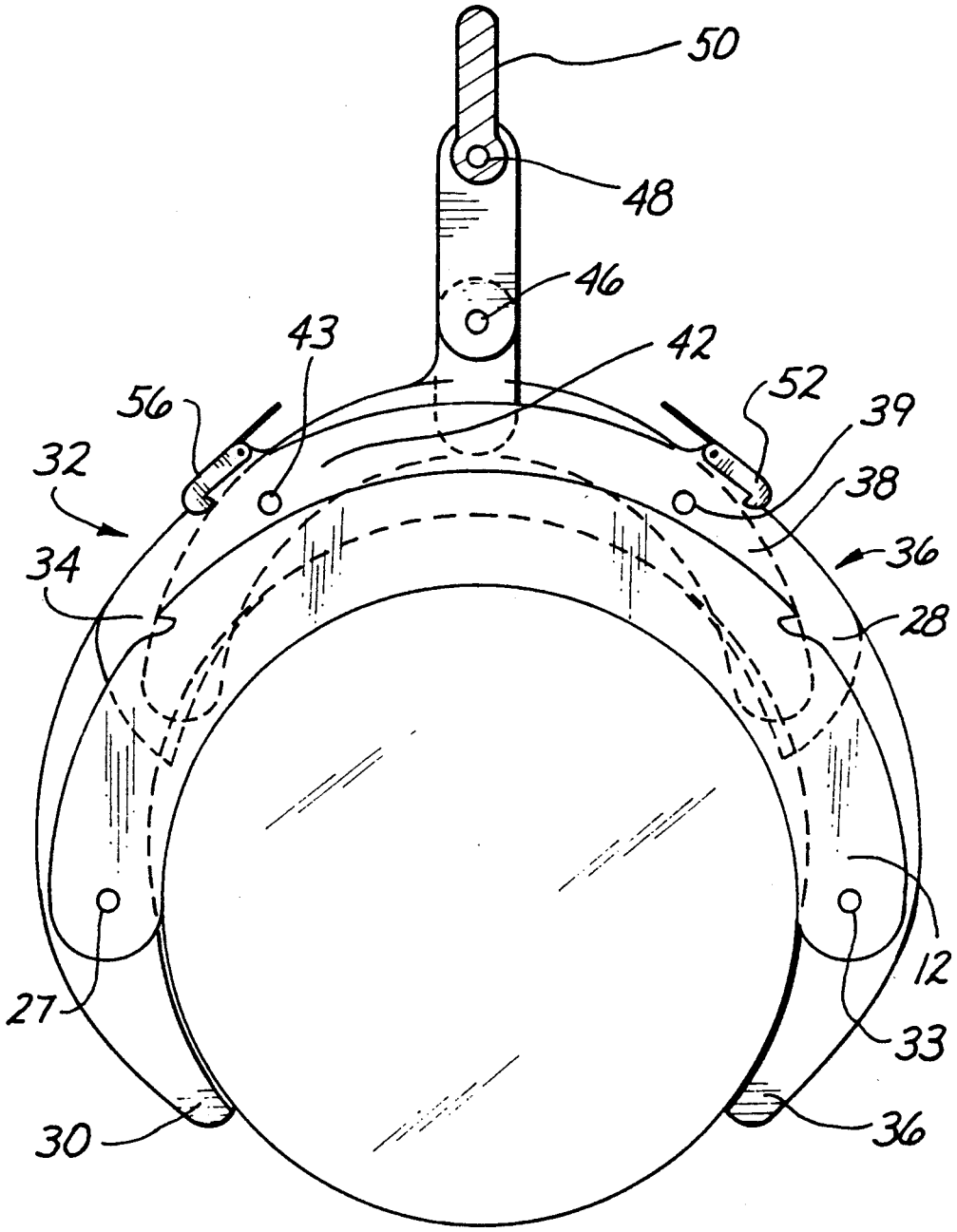
FIG. 3 is a side view, of apparatus in accordance with the invention in a closed position.
Figure 4:
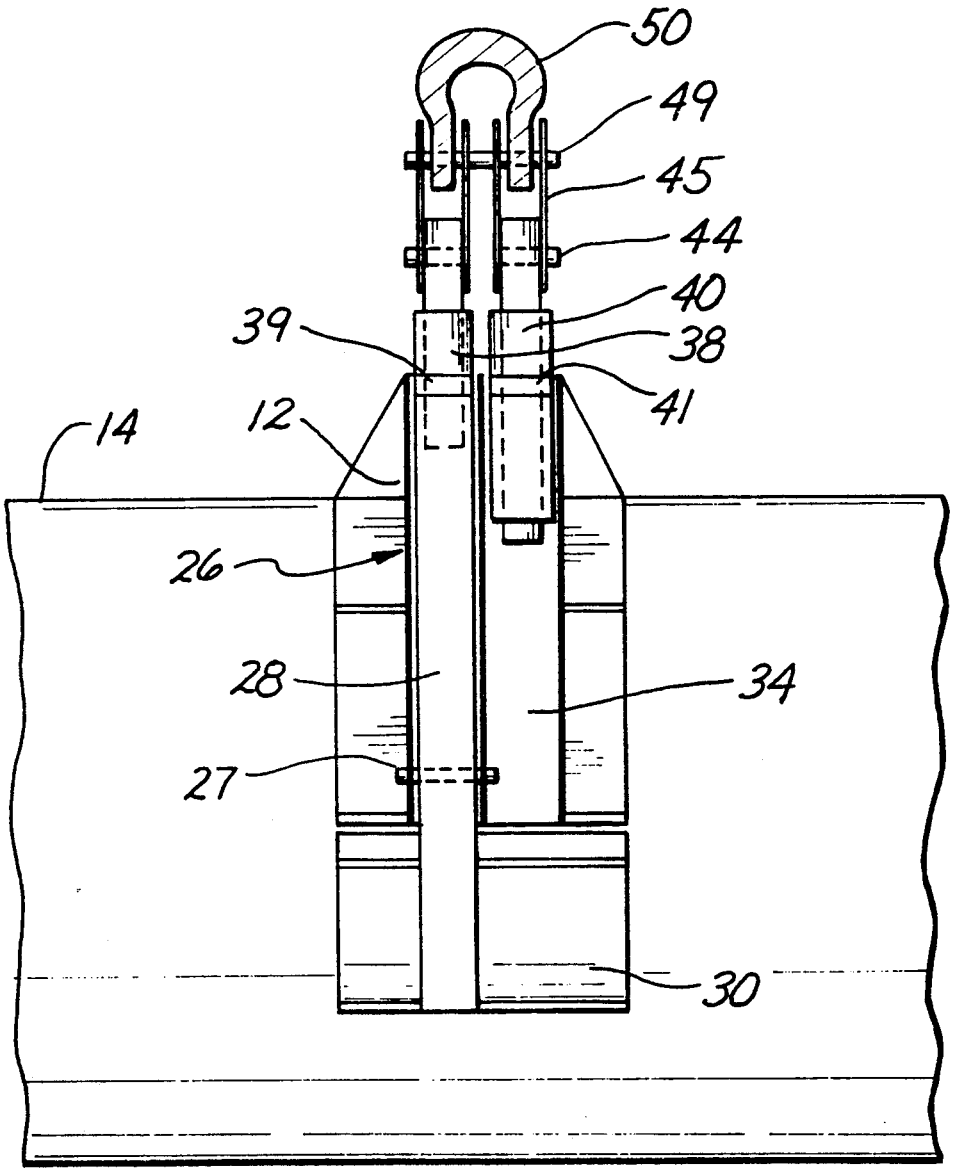
FIG. 4 is an end view of apparatus in accordance with the invention.
Figure 5:
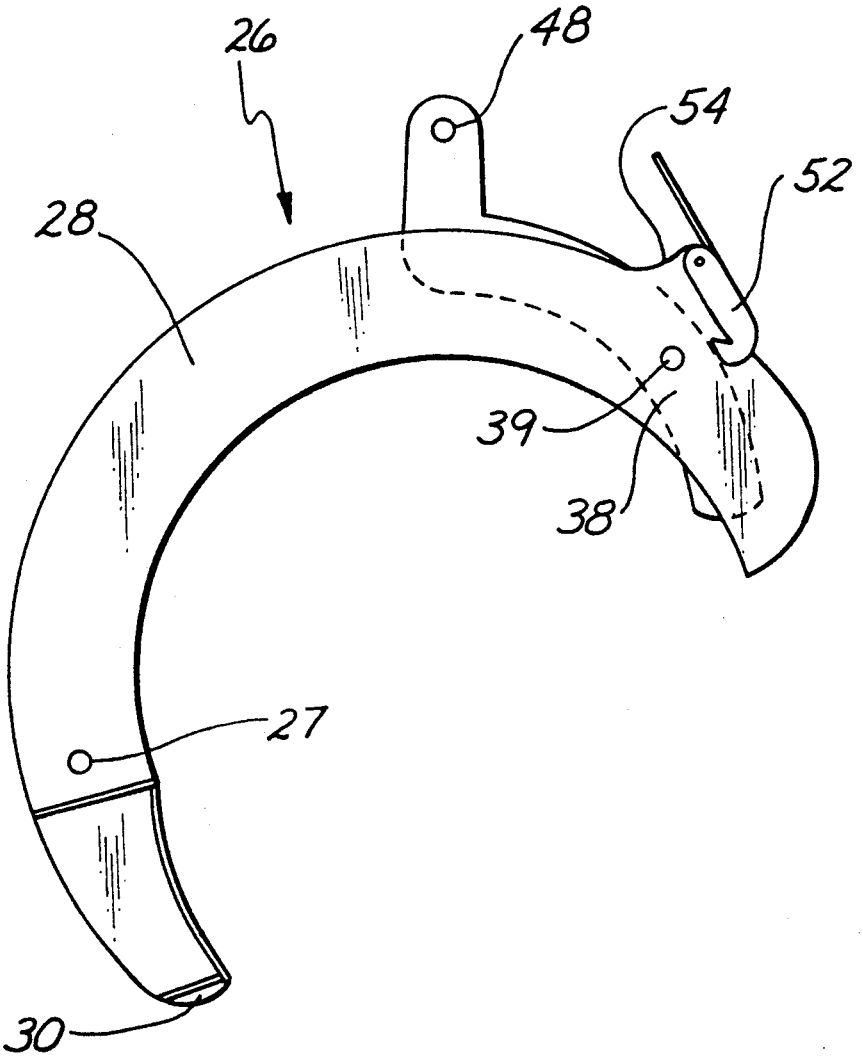
FIG. 5 is a fragmentary view of a portion of apparatus in accordance with the invention.

As depicted in FIGS. 1–5, inclusive, gripping and lifting apparatus 10 in accordance with the invention comprises a stationary member in the form of a saddle 12 configured with arcuate contour to be fittable onto a workpiece depicted herein as a cylindrical pipe 14 having a horizontal diameter 15 through the center of the depicted circular transverse cross-section of the workpiece 14, such diameter being also known as the springline of the workpiece 14. In the embodiment depicted, the saddle 12 has a circular extent of substantially 180° of arc. For efficient operation of apparatus 10, the arcuate extent of stationary member 12 should not deviate more than ten (10°) degrees of arc from 180°.

The saddle 12 includes three longitudinal parallel strongbacks 16,18,20 defining recesses 22, 24. Saddle 12 also includes a plurality of strengthening gussets 25 at the sides thereof. A first moveable gripping member 26 is pivotably mounted by a pin 27 on saddle 12 between strongbacks 18 and 20. First moveable gripping member 26 is in the form of an arm 28 having at the lower end thereof a gripping engagement section 30 having substantially a paddle shape. First moveable member 26 is mounted at an angular distance not exceeding ninety degrees (90°) of arc from the center of arc of saddle 12 and at or above the horizontal diameter 15 of workpiece 14.

A second moveable gripping member 32 identical to first moveable gripping member 26 is pivotably mounted by a pin 33 on saddle 12 between strongbacks 18,20 and comprises an arm 34 and a gripping engagement section 36, gripping engagement sections 30, 36 being positioned upon their respective arms 28, 34 such that they substantially oppose one another across the workpiece 14. Second moveable member 32 is mounted at an angular interval not exceeding ninety degrees (90°) from the center of arc of saddle 12.

Thus, first member 26 and second member 32 are substantially symmetrically mounted with respect to saddle 12 and workpiece 14 and with pivot points displaced at an angular interval not exceeding 180° from one another. Under this arrangement, members 26, 32 are pivotably mounted on saddle 12 above, or collinear with the horizontal diameter 15 of workpiece 14, but not below the diameter 15.

A first cam member 38 is pivotably mounted by pin 39 on arm 28 of moveable member 26, adjacent the opposite end thereof from gripping engagement section 30. Cam member 38 is journalled and configured to be moveable into engagement with saddle 12, as is more fully described hereinbelow.

A second cam member 42 is pivotally mounted by pin 43 in second moveable gripping member 32 in the same relative position and in the same manner with respect to that member as is first cam member 38 with respect to the first moveable gripping member 26.

First cam member 38 is connected at pivot 44 to first linkage member 45. In the same manner, second cam member 42 is connected at pivot 46 to second linkage member 47. Linkage members 45, 47 are connected at pivot 48 to a coupling member in the form of shackle 50 which is connectable to a source (not shown) of lifting force.

As seen in FIGS. 1–4, inclusive, a first latch member 52 is journalled onto a boss 54 in first moveable gripping member 26 at arm 28 thereof. First latch member 52 has its counterpart in second latch member 56 journalled on boss 58 in second arm 34. (For purposes of clarity only, first latch member 52 is omitted from FIG. 2). First latch member 52 and second latch member 56 are similarly configured and are hook-shaped at one of their ends to engage with a first slot 60 and a second slot 62, respectively, defined in the saddle member 12. In the open position (i.e. non-gripping configuration), the first and second latch members 52, 56 are engaged with their respective slots 60, 62 to hold the apparatus in the open position until lifting takes place.

First latch member 52 and second latch member 56 are biased to the open position (i.e., into engagement with slots 60, 62) by virtue of their weight and journalling on the bosses 54, 58 which act as fulcrums for the levering action of the latch members, such biasing facilitating lifting and release of the workpiece 14.

In operation of the apparatus in accordance with the invention, saddle 12 is brought into contact with the workpiece 14. This requires that the saddle 12 have essentially the same curvature as the workpiece 14 and to extend substantially at least 170° along the periphery of the workpiece. In some applications wherein the outer diameter of the workpiece is smaller than the saddle 12, interstitial material such as heavy wadding can be placed upon the workpiece 14 to bolster its curvature to facilitate engagement by the saddle 12. Operation of the apparatus 10 may be conducted, for example, in a trench from which a workpiece 14 (which, for example, could constitute old pipe) is to be removed. At this point, with the stationary saddle member 12 resting upon the workpiece 14, the first and second arms 28, 34 are spaced away from the workpiece 14 in the open position. The amount of space necessary in a trench for fitting the apparatus onto a workpiece and into gripping engagement therewith, when there are two moveable gripping members, as in the present invention, as opposed to a single gripping member, is substantially decreased. This eliminates the need to shift the apparatus laterally to disengage the apparatus from the workpiece as required by single moveable arm equipment. With the use of a pair of gripping members, safe lifting capacity is increased over that of devices of similar size utilizing only one moveable gripping member. This is due to the fact that the capability of a larger arcuate coverage of the workpiece can be accomplished (approximately 240° in the depicted embodiment) than with existing devices because existing devices with such coverage would require excessively large space in trenches for engagement and disengagement with respect to the workpiece.

Once the stationary saddle member 12 is positioned upon the workpiece 14 with the members 26,32 in the open position and with their respective pivots 27,33 not below the horizontal axis 15 of workpiece 14, lifting force is exerted upon shackle 50. This has the effect of pulling up first and second cam members 38, 42 which rotate into engagement with saddle 12. Concurrently, the lifting motion imparted to the shackle 50 causes the first and second latch members to disengage so that the apparatus reaches the closed (i.e. lifting) position. In this position, the gripping engagement sections 30, 36 of first and second moveable gripping members 26, 32 are frictionally engaged with the workpiece 14, and the first and second cam members are rotated into engagement with the stationary saddle member 12. After lifting, and then laying, the workpiece 14 in the desired location, the lifting force is removed from shackle 50. As a consequence of this, the apparatus assumes the open position, and it can be moved to storage or to the next job.

Thus, in accordance with the invention, apparatus is provided for lifting and gripping massive workpieces with improved efficiency, safety and compactness of operation, the foregoing specification and disclosure being exemplary only and not limitative of the invention, which is defined by the appended claims.

What is claimed is:

1. Apparatus for gripping and lifting workpieces comprising:

a stationary member configured to be fittable into engagement with a workpiece, said workpiece having a springline;

a first gripping member pivotably mounted upon said stationary member by first pivot means not lower than said springline;

a second gripping member pivotably mounted upon said stationary member by second pivot means not lower than said springline, said first gripping member and said second gripping member being positioned on said stationary member to move in separate paths from one another, said first gripping member including a gripping engagement section, and said second gripping member including a gripping engagement section, the gripping engagement section of said first gripping member and the gripping engagement section of said second gripping member being positioned to e substantially opposite one another;

a first cam member pivotably mounted upon said first gripping member;

a second cam member pivotably mounted upon said second gripping member, said first cam member and said second cam member being positioned to be moveable through separate paths from one another, said first cam member having an open position in which it is disengaged from contact with said stationary member and a closed position in which it is engaged with said stationary member, said second cam member having an open position in which it is disengaged from the stationary member and a closed position in which it is engaged with the stationary member;

linkage means for connecting said first cam member and said second cam member to a source of lift, such that upon lift being exerted thereon, said first cam member and said second cam member are thereby moved to said closed positions thereof, said first cam member being connected to said first ripping member such that in said closed position of said first cam member said gripping engagement section of said first gripping member is in gripping engagement with said workpiece and the force of said gripping engagement increases with increasing lifting force, said second cam member being connected to said second gripping member such that in said closed position of said second cam member said gripping engagement section of said second gripping member is in gripping engagement with the workpiece and the force of said gripping engagement increases with increasing lifting force.

2. The apparatus as set forth in claim 1 wherein said linkage means comprises a first linkage member pivotably connected to said first cam member and further comprises a second linkage member pivotably connected to said second cam member and wherein such first linkage member and said second linkage member are connected to a coupling member coupleable to said source of lift.

3. The apparatus as set forth in claim 1 further including a first latch member journalled on said first gripping member and being configured to make latching engagement with a first slot, said first slot being defined in said stationary member, said first latch member being moveable to perform said latching engagement with said first slot upon movement of said first cam member to said open position and to be disengaged from said first slot when said first cam member is in said closed position, and further including a second latch member journalled on said second gripping member and being configured to make latching engagement with a second slot, said second slot being defined in said stationary member, said second latch member being moveable to engage in said latching engagement with said second slot upon movement of said second cam member to said open position and to be disengaged from said second slot when said second cam member is in said closed position.

4. The apparatus as set forth in claim 3 wherein said first latch member is journalled in said first gripping member above the position of said first gripping member's gripping engagement section.

5. The apparatus as set forth in claim 4 wherein said stationary member is arcuate and comprises less than 180° of arc.

6. The apparatus as set further in claim 4 wherein said first gripping member and said second gripping member extend substantially symmetrically from the opposite ends of said stationary member to form a circular configuration substantially equal to 240° of arc.

7. The apparatus as set forth in claim 3 wherein said latch members are biased to said latching engagement virtue of their weight exerting a levering action.

8. The apparatus as set forth in claim 1 wherein said stationary member is substantially circular in configuration and defines a first recess for containing said first gripping member and further defines a second recess for containment of said second gripping member.

9. The apparatus as set forth in claim 8 wherein said recesses are defined between pairs of a plurality of strongback members integral with said stationary member.

* * * * *